US007780418B2

(12) United States Patent
Wang

(10) Patent No.: US 7,780,418 B2
(45) Date of Patent: Aug. 24, 2010

(54) QUICK ASSEMBLY BLADE FOR A CEILING FAN

(75) Inventor: Cliff Wang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 570 days.

(21) Appl. No.: 11/832,122

(22) Filed: Aug. 1, 2007

(65) Prior Publication Data

US 2009/0035142 A1 Feb. 5, 2009

(51) Int. Cl.
*F04D 29/34* (2006.01)

(52) U.S. Cl. ..... 416/210 R; 416/207; 416/214 R

(58) Field of Classification Search ..... 416/210 R, 416/204 R, 207, 244 R, 214 R, 220 R; 464/70, 464/71

See application file for complete search history.

(56) References Cited

U.S. PATENT DOCUMENTS 7,351,037 B1 * 4/2008 Mares et al. ..... 416/210 R

* cited by examiner

*Primary Examiner*—Edward Look
*Assistant Examiner*—Dwayne J White
(74) *Attorney, Agent, or Firm*—Ming Chow; Sinorica, LLC

(57) ABSTRACT

A quick assembly blade for a ceiling fan includes a blade frame, a blade and a clamping member. The blade frame is fixed therein with at least three studs spaced apart equidistantly for a fastener to be respectively locked therein. The blade has one end bored with insert holes at the locations corresponding to the studs of the blade frame for the fasteners to be respectively inserted therethrough. The clamping member plate-shaped is secured on the blade at a location matching with the blade frame, having one end cut with two engage notches corresponding to two adjacent fasteners below and the other end provided with an elastic engage portion. The clamping member can be quickly pressed and fixed on the blade by means of its engage notches and its elastic engage portion to enable the blade to be assembled on the blade frame quickly and stably.

4 Claims, 4 Drawing Sheets

QUICK ASSEMBLY BLADE FOR A CEILING FAN

BACKGROUND OF THE INVENTION

1. Field of the Invention

This invention relates to a ceiling fan blade, particularly to one able to be assembled on a blade frame quickly and stably.

2. Description of the Prior Art

A blade-assembling device for a conventional ceiling fan, as shown in FIG. 1, includes a blade frame 1, a blade 2 and a plurality of fastening members 3 combined together. The blade frame 1 is formed integral with a fixed portion 4, a neck portion 5 and a blade-connecting portion 6. The fixed portion 4 is connected with a blade motor (not shown), having one end extended downward and connected with the neck portion 5, and the blade-connecting portion 6 is a parallel Y-shaped plate extended transversely from the bottom of the neck portion 5 and toward the blade 2. The blade-connecting portion 6 is annularly bored with three locking holes 7 spaced apart equidistantly, and the blade 2 has one end annularly bored with three insert holes 8 respectively corresponding to the three locking holes 7 of the blade-connecting portion 6. In assembling, firstly, the insert holes 8 of the blade 2 are respectively aligned to the locking holes 7 of the blade-connecting portion 6, and then the fastening members 3 are respectively inserted through the insert holes 8 from the topside of the blade 2 and secured in the locking holes 7 of the blade-connecting portion 6.

For assembling of the blade 2 on the blade frame 1, the insert holes 8 of the blade 2 have to be respectively aligned to the locking holes 7 of the blade-connecting portion 6, but it is no easy work to quickly have them aligned to each other, always wasting much time and labor in assembling the blade. In addition, the blade 2 is assembled on the blade frame 1 only by plural fastening members 3 without any pressing force great enough to press the topside of the blade 2; therefore, the blade 2 cannot be assembled on the blade frame 1 with great stability.

SUMMARY OF THE INVENTION

The objective of this invention is to offer a quick assembly blade for a ceiling fan, including a blade frame, a blade and a clamping member. The blade frame has a holding surface secured thereon with at least three studs respectively for a fastener to be locked therein. The blade fixed on the blade frame is bored with insert holes at the locations matching with the studs of the blade frame for the fasteners to be respectively inserted therethrough for positioning the blade on the blade frame. The clamping member fixed on the blade at a location corresponding to the blade frame has one end cut with engage notches at the locations corresponding to two adjacent fasteners, and the other end disposed with an elastic engage portion opposite to the engage notches. The elastic engage portion is bored with a positioning hole at a location matching with another fastener, with the circumference of the positioning hole cut with at least two elongate notches and having an elastic engage strip formed between every two notches for quickly clasping the fastener so as to firmly fix the clamping member on the blade. By so designing, the blade of this invention can be quickly and stably assembled on the blade frame.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
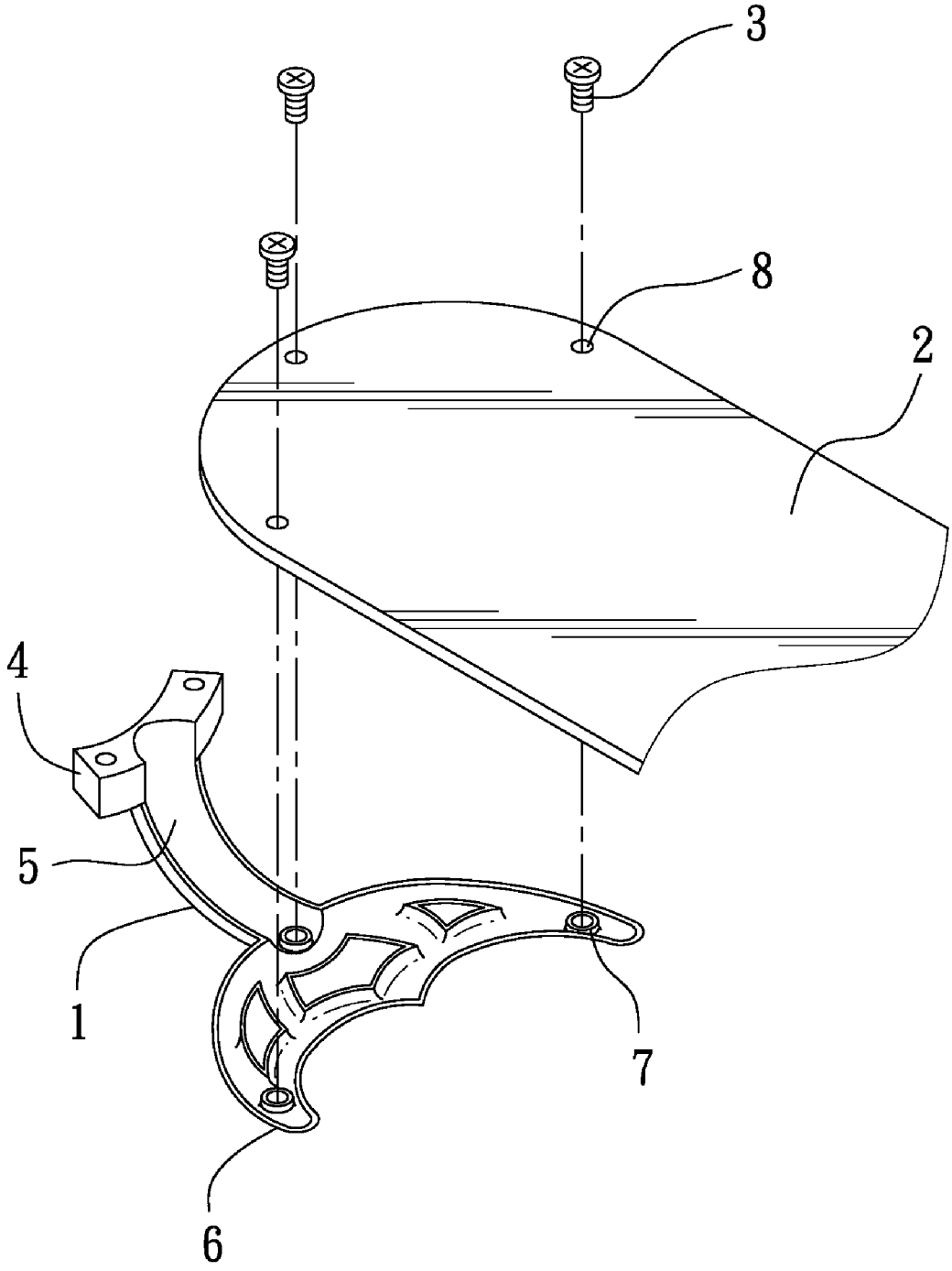
FIG. 1 PRIOR ART
FIG. 1 is an exploded perspective view of a blade-assembling device for a conventional ceiling fan.
Figure 2:
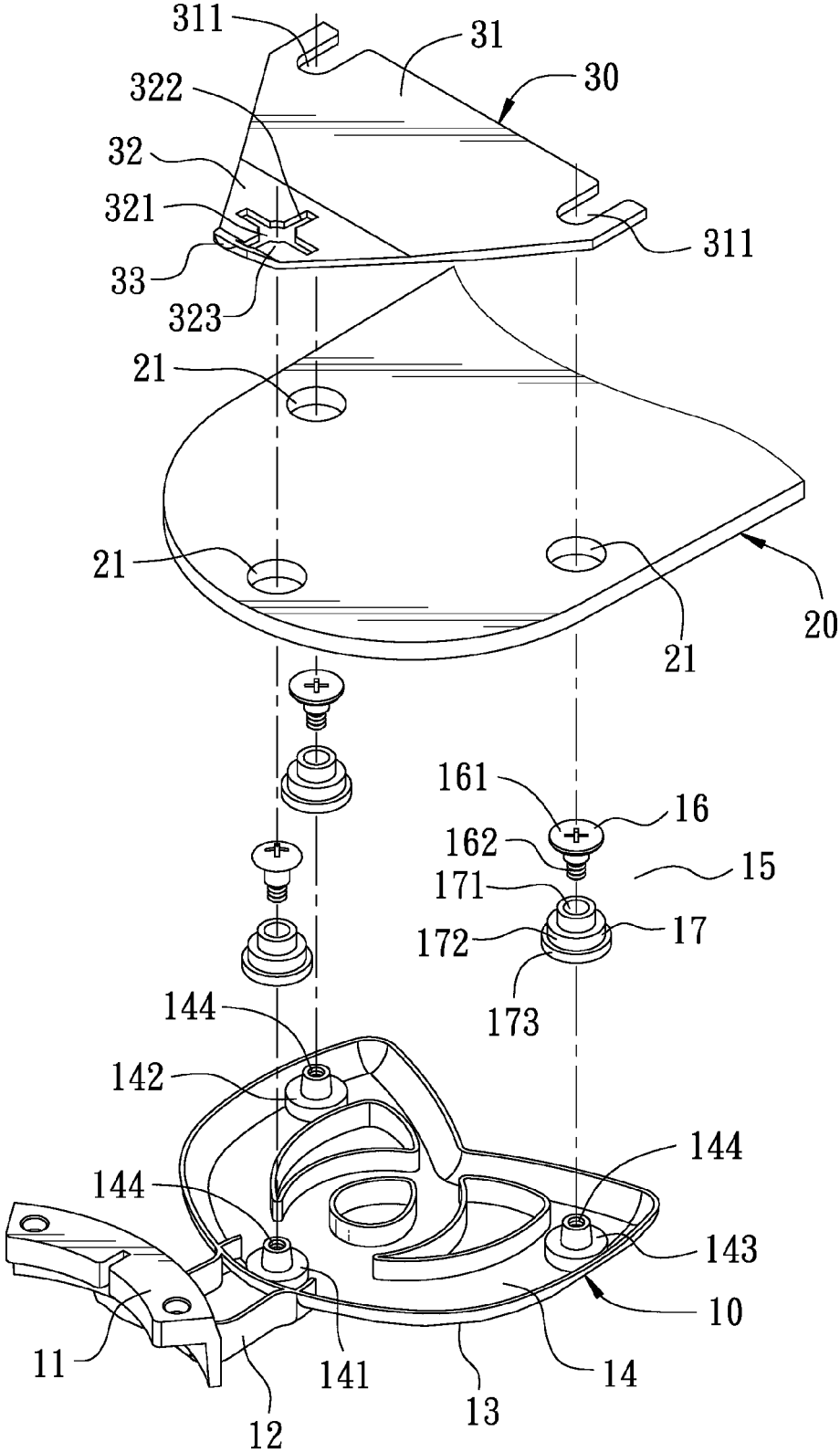
FIG. 2 is an exploded perspective view of a quick assembly blade for a ceiling fan in the present invention.

A preferred embodiment of a quick assembly blade for a ceiling fan in the present invention, as shown in FIG. 2, includes a blade frame 10, a blade 20 and a clamping member 30.

The blade frame 10 is formed integral with a fixed portion 11, a neck portion 12 and a blade-connecting portion 13. The fixed portion 11 is an arcuate vertical plate for connecting a blade motor (not shown), and the neck portion 12 is transversely extended from the bottom of the fixed portion 11, having the other end connected with the blade-connecting portion 13. The blade-connecting portion 13 is formed with a pan-shaped holding surface 14 facing upward and having its circumference annularly fixed with the three vertical studs 141, 142 and 143 spaced apart equidistantly, with the stud 141 positioned abutting the neck portion 12, and the studs 142 and 143 positioned in parallel at the left and the right side opposite to the stud 141. The three studs 141, 142 and 143 are respectively bored with a threaded hole 144 in the center for a fastener 15 to be inserted therein. In the preferred embodiment, each fastener 15 is composed of a locking member 16 and a tightening ring 17. The locking member 16 is a bolt formed with a head 161 and a threaded section 162 extending downward from the head 161, and the tightening ring 17 made of rubber is composed of a small-sized upper columnar member 171, a medium-sized intermediate columnar member 172 and a large-sized lower columnar member 173. The threaded sections 162 at the lower end of the locking members 16 are respectively inserted through the tightening rings 17 and then secured in the studs 141, 142 and 143 of the blade frame 10.

The blade 20 fixed on the blade frame 10 is bored with three insert holes 21 at the locations matching with the three studs 141, 142 and 143, and the fasteners 15 are respectively inserted through the insert holes 21 and have the intermediate columnar members 172 of the tightening rings 17 respectively stuck on the inner walls of the insert hole 21 of the blade 20, letting the 161 of the fastener 15 extending out of the topside of the blade 20 and thus quickly positioning the blade 20 on the blade frame 10.

Figure 3:
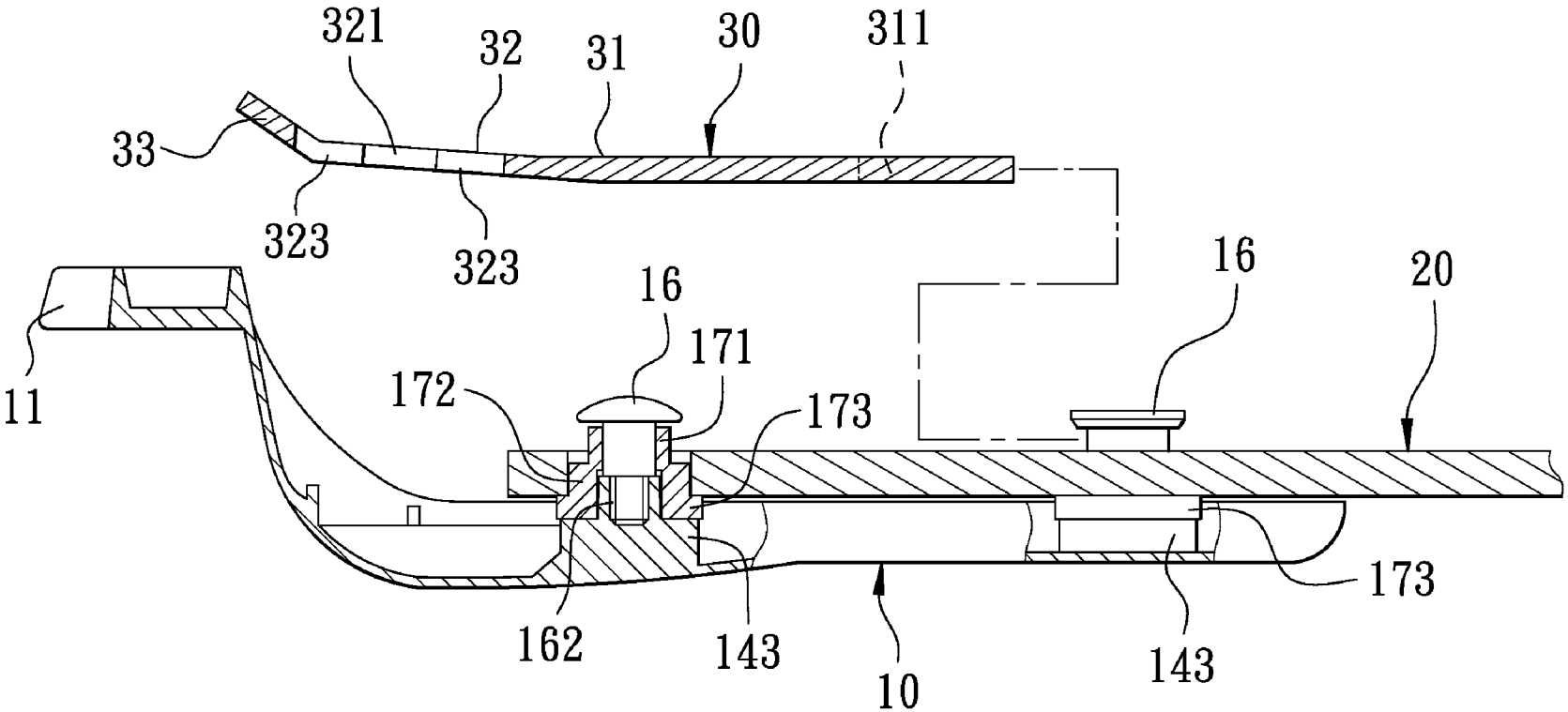
FIG. 3 is a partial exploded and side cross-sectional view of the quick assembly blade for a ceiling fan in the present invention.
Figure 4:
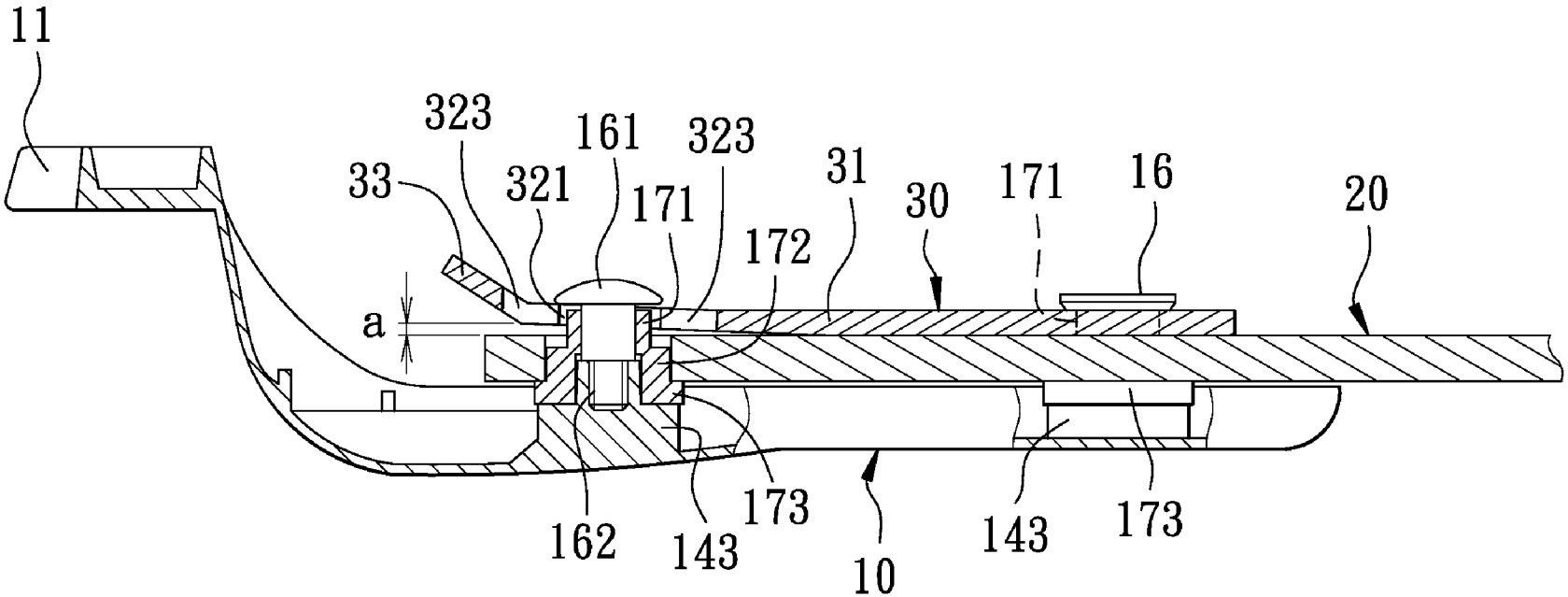
FIG. 4 is a side cross-sectional view of the quick assembly blade for a ceiling fan in the present invention.

The clamping member 30, referring to FIGS. 3 and 4, is fixed on the blade 20 at a location corresponding to the blade frame 10. The clamping member 30 is transversely provided with a triangular board-shaped clamping portion 31 having one edge cut with two U-shaped engage notches 311 at the locations corresponding to the studs 142 and 143 of the blade frame 10, with the openings of the two U-shaped engage notches 311 facing the two adjacent fasteners 15. The clamping portion 31 has the other edge, opposite to the engage notches 311, provided with an elastic engage portion 32 slanting upward slightly and forming an elevation angle, with a press angle (a) formed between the engage portion 32 and the topside of the blade 20. The elastic engage portion 32 has its rear end extended and formed with an operating portion 33, which is a block member turned upward for a proper angle. Further, the engage portion 32 is bored with positioning hole

321 at a location matching with the fastener 15 on the stud 141. The positioning hole 321 is a little smaller than the head 161 of the fastener 15 and has its circumference annularly bored with four elongate notches 322 spaced apart equidistantly, with an elastic engage strip 323 formed between every two abutting notches 322 to let the positioning hole 321 and the four elongate notches 322 make a cross shape.

In assembling of the ceiling fan blade, firstly, the threaded sections 162 at the lower ends of the locking members 16 of the fasteners 15 are respectively inserted through the tightening rings 17 and then secured in the stud 141, 142 and 143 of the blade frame 10. Next, the blade 20 has its insert holes 21 respectively inserted through the stud 141, 142 and 143 and stuck on the columnar members 172 of the tightening rings 17, letting the heads 161 of the fastener 15 and the columnar members 171 of the tightening rings 17 protruding out of the topside of the blade 20 to position the blade 20 on the blade frame 10. Subsequently, the two engage notches 311 at one edge of the clamping member 30 are respectively and correspondingly engaged with the columnar members 171 of the fasteners 15 on the studs 142 and 143 to fix the heads 161 of the locking members 16 on one end of the clamping member 30. Referring to FIG. 4, since there is the press angle (a) formed between the engage portion 32 of the clamping member 30 and the blade 20; therefore, when the operating portion 33 is pressed down, the engage portion 32 will be actuated to move downward and press the blade 20 to force the head 161 of the fastener 15 to pass through the insert hole 21 of the blade 20, letting the columnar member 171 under the head 161 together with the head 161 of the locking member 16 quickly clasped by the elastic engage strips 323 around the circumference of the insert hole 21. When released from the pressing force, the engage portion 32 will recover to its original slanting position by its own restored elastic force, thus finishing assembly of the blade 20.

To disassemble and replace the ceiling fan blades, simply press down the operating portion 33 of the clamping member 30 to let the engage portion 32 forced to spring upward and the positioning hole 321 quickly disengaged from the head 161 of the locking member 16. Then, the engage notches 311 of the clamping member 30 are disengaged from the studs 142 and 143, and the fasteners 15 are unfastened to separate the blade 20 from the blade frame 10.

To sum up, this invention has some advantages as described below.

1. The fasteners locked on the studs of the blade frame enable the blade to be quickly positioned on the blade frame, and the clamping member can be quickly and firmly pressed on the blade; therefore, the blade can be assembled on the blade frame conveniently, quickly and stably.

2. The press angle formed between the engage portion of the clamping member and the blade enables the engage portion to be pressed downward by the operating portion of the clamping member so that the clamping member can be quickly pressed downward and engaged with the fasteners below. When released from the pressing force, the engage portion will recover its original slanting position by its own restored elastic force, thus able to assemble the blade on the blade frame easily and quickly.

While the preferred embodiment of the invention has been described above, it will be recognized and understood that various modifications may be made therein and the appended claims are intended to cover all such modifications that may fall within the spirit and scope of the invention.

I claim:

1. A quick assembly blade for a ceiling fan comprising:
a blade frame formed integral with a fixed portion;
a neck portion;
a blade-connecting portion;
said blade-connecting portion being provided with a holding surface facing upward;
said holding surface having its circumference being fixed with three studs spaced apart equidistantly;
said three studs being respectively bored with a threaded hole in the center;
said threaded hole being secured therein with a fastener;
said fastener being formed with a head to be engaged;
a blade having one end being secured on said blade frame;
said blade being bored with insert holes at locations corresponding to said studs of said blade frame;
a clamping member being fixed on said blade at a location corresponding to said blade frame;
said clamping member being formed with a plate-shaped clamping portion;
said clamping portion having one edge cut with two notches and having their openings respectively facing two adjacent said fasteners;
said clamping portion having another edge being extended and formed with an elastic engage portion;
said elastic engage portion being bored with a positioning hole matching with said fastener below;
said positioning hole is smaller than said fastener below;
said positioning hole having its circumference annularly cut with at least two notches spaced apart equidistantly;
an elastic engage strip being formed between said notches;
said elastic engage portion of said clamping member is annularly bored with four elongate notches; and
said positioning hole and said four elongate notches are formed into a cross shape.

2. The quick assembly blade for a ceiling fan as claimed in claim 1, wherein said engage portion of said clamping member has its rear end extended and formed with an operating portion.

3. The quick assembly blade for a ceiling fan as claimed in claim 1, wherein each said fastener is disposed with a lower tightening ring and an upper locking member, said tightening ring made of rubber and composed of a small-sized upper columnar member, a medium-sized intermediate columnar member and a large-sized lower columnar member, said head of said locking member having its lower end extended downward and formed with a threaded section, said threaded section inserted through said tightening ring and engaged with said stud on said blade frame.

4. The quick assembly blade for a ceiling fan as claimed in claim 1, wherein said engage notches of said clamping member are U-shaped.

* * * * *